US006336229B1

(12) United States Patent
Guo

(10) Patent No.: US 6,336,229 B1
(45) Date of Patent: Jan. 8, 2002

(54) WATER SAVING APPARATUS FOR WATER TANK

(76) Inventor: Jeng-Yeou Guo, No. 35, 40th Rd., Industrial Dist., Taichung (TW)

( * ) Notice: Subject to any disclaimer, the term of this patent is extended or adjusted under 35 U.S.C. 154(b) by 0 days.

(21) Appl. No.: 09/706,804

(22) Filed: Nov. 7, 2000

(51) Int. Cl.[7] ..... E03D 1/14
(52) U.S. Cl. ..... 4/325; 4/394; 4/404
(58) Field of Search ..... 4/324, 325, 393, 4/394, 403, 404

(56) References Cited

U.S. PATENT DOCUMENTS 5,943,708 A * 8/1999 Chen ..... 4/325
6,263,520 B1 * 7/2001 Song ..... 4/325

* cited by examiner

*Primary Examiner*—Robert M. Fetsuga
(74) *Attorney, Agent, or Firm*—Bacon & Thomas, PLLC

(57) ABSTRACT

A water saving apparatus for water tank includes a stop valve means located above a water outlet, a linkage bar means located above the stop valve means and two chains for connecting the stop valve means with the linkage bar means. The stop valve means has a valve cap engaged with a movable strut and a hollow ball for linking to a tank ball. The linkage bar means has a handle located outside the water tank. The handle engages with a shaft stem and a shaft sleeve for actuating two beams located inside the tank. The chains connect the beams respectively with the tank ball, hollow ball and movable strut. Moving the handle downward, one beam will be moved up to make the hollow ball become buoyant for opening the water outlet rapidly to release a large amount of water to flush feces. Moving the handle upward, another beam will be moved up to make the hollow ball become not buoyant for closing the water outlet sooner so that a small amount of water will be released for flushing urine for saving water.

1 Claim, 10 Drawing Sheets

WATER SAVING APPARATUS FOR WATER TANK

BACKGROUND OF THE INVENTION

This invention relates to a toilet tank and particularly a toilet water tank that has a valve cap for closing water outlet tightly and a water saving means to couple with the valve cap for saving toilet flush water.

The awareness and concerns for environmental protection and resources conservation have been wide spread around the world in recent years. Water is one of the critical resources affecting people's life everyday. Fresh water has limited supply and its availability highly depends on geographical and weather conditions which are mostly out of people's control. Hence water conservation is an issue many people are keenly aware of nowadays. To help people to conserve water resource and reduce waste, a wide variety of water saving devices and facilities have been developed and introduced over the years. Some statistics show that, among people's water consumption in their daily life, consumption of toilet flush water is even greater than drinking water. Hence many water saving devices for toilet use have been proposed and developed to reduce water waste. FIG. 1 and 2 show a conventional toilet tank for this purpose. It has two handles outside the tank for controlling a valve inside the tank. One handle may open the valve to a larger degree for releasing a larger amount of water to flush feces while another handle may open the valve to a smaller degree for releasing a smaller amount of water to flush urine. It may save water consumption. However the valve is usually integrally made of a soft rubber which cannot close water outlet tightly. Water leakage through the valve is prone to happen. There is still room for improvement.

SUMMARY OF THE INVENTION

It is an object of this invention to provide a water saving toilet tank that has a novel stop valve means and a linkage bar means to control and release different amount of water through a water outlet for flushing feces and urine so that water may be used more effectively and economically.

According to this invention, the tank has two beams to actuate a movable strut which in turn may cause a hollow ball to float or sink. The floating hollow ball may open the water outlet rapidly for releasing a required amount of water to flush feces. The sinking hollow ball will close the water outlet sooner for releasing a smaller amount of water to flush urine. The height of the tank ball may be adjusted for changing amount of water to be released for flushing urine.

In one aspect of this invention, the tank includes a stop valve means and a linkage bar means located above the stop valve means. The stop valve means and linkage bar means are connected by two chains at two ends thereof.

The stop valve means is located above a water outlet and includes a valve cap which has a round opening and a pair of valve lugs, a movable strut which engages with two valve disks and has a transverse trough and a wedge slot formed at an upper section thereof, a semi-spherical hollow ball having an inlet and a through hole for water and air to circulate therethrough, a rocker which has one end engageable with the transverse trough and another end formed a pinch slot and a rocker lug in the middle thereof pivotally engaged with the valve lugs for functioning like a lever.

The linkage bar means includes a flush handle located outside the tank, a shaft sleeve located inside the tank which has one end provided with two notches and three levers each has a bore formed therein, a shaft stem housed in the shaft sleeve having two fingers at one end thereof, and two beams each has one end formed a trigger end and another end having a plurality of slant openings and a pivot strut located near the trigger end pivotally engageable with the bore of the shaft sleeve.

There are further a tank ball and two chains in the tank. The tank ball has an aperture. One chain has one end engaged with the aperture of the tank ball and another end engaged with the wedge slot of the movable strut. Another chain has one end engaged with the slant opening and another end engaged with the pinch slot of the rocker.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENT

Figure 1:
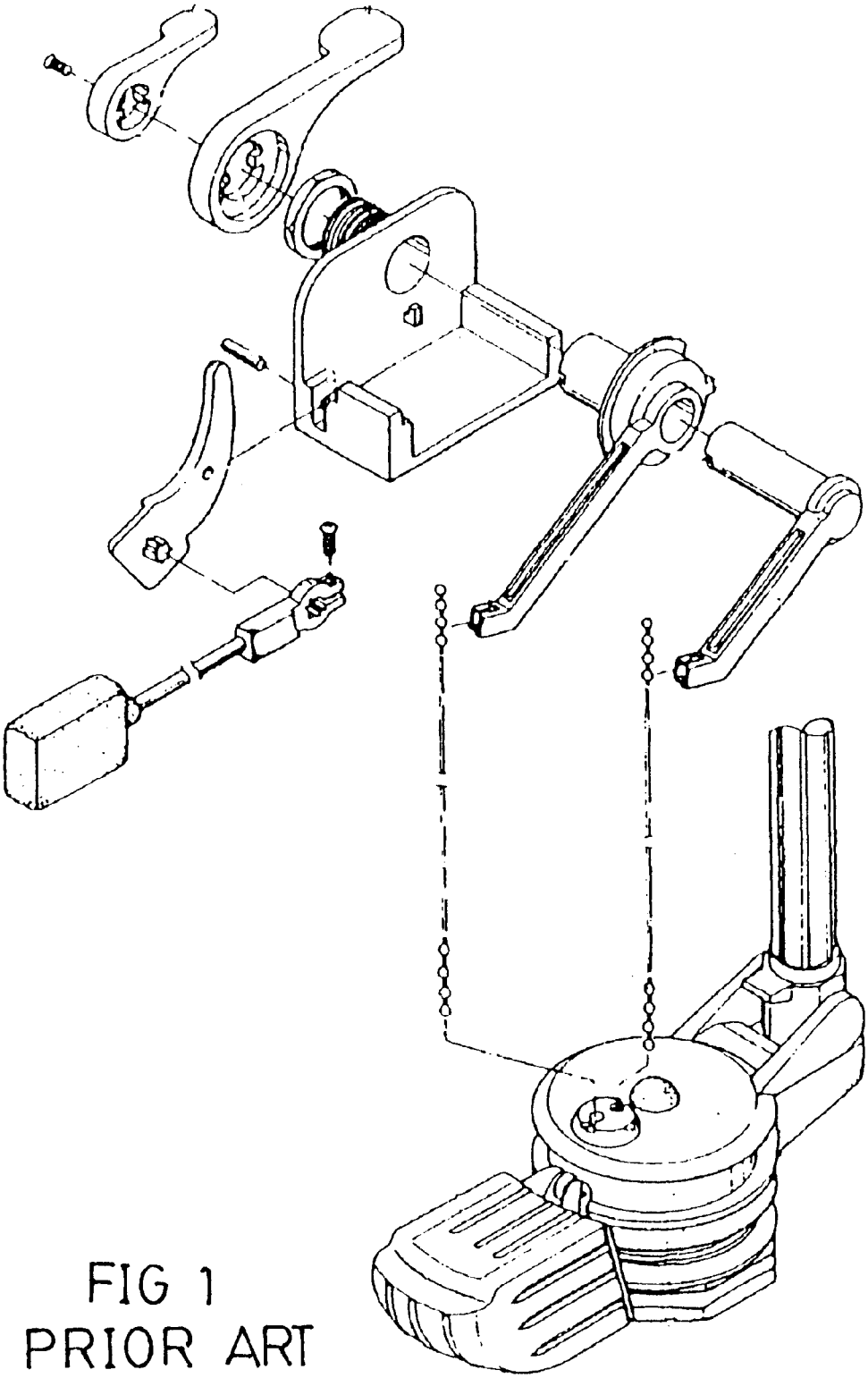
FIG 1 PRIOR ART
FIG. 1 is an exploded view of a flush control mechanism for a conventional toilet tank.
Figure 2:
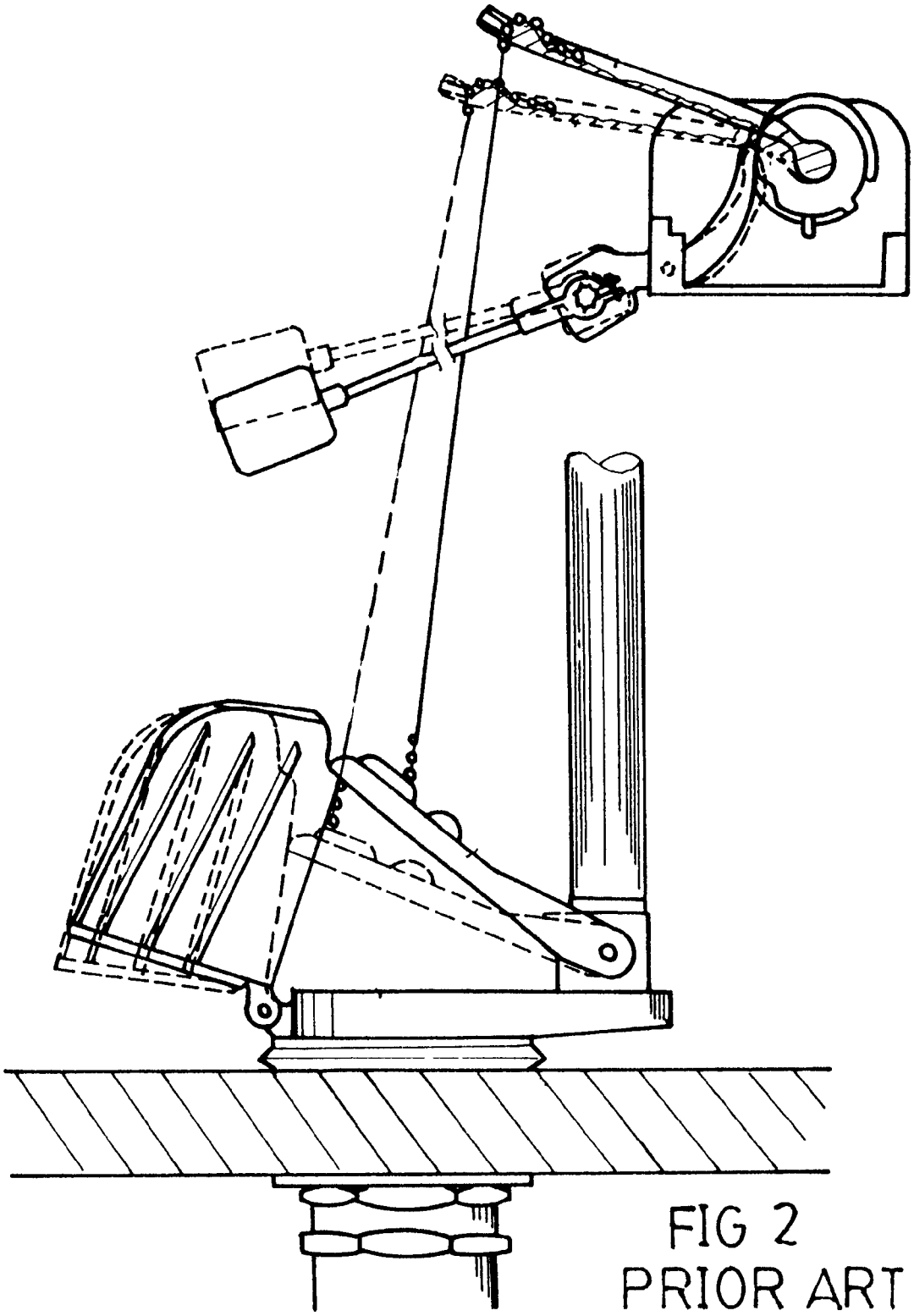
FIG 2 PRIOR ART
FIG. 2 is a schematic side view of the flush mechanism according to FIG. 1.
Figure 3:
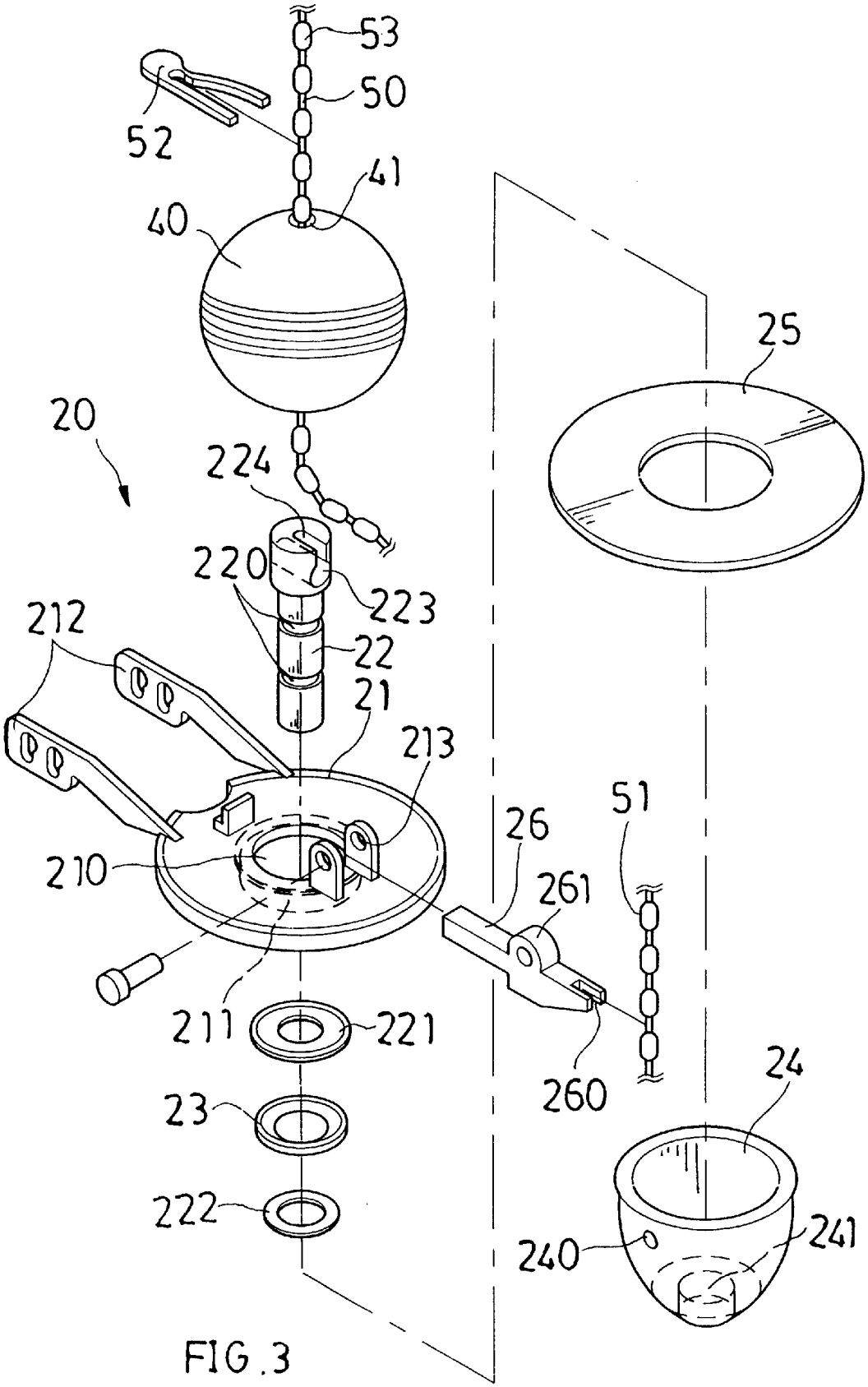
FIG. 3 is an exploded view of a stop valve means of this invention.
Figure 4:
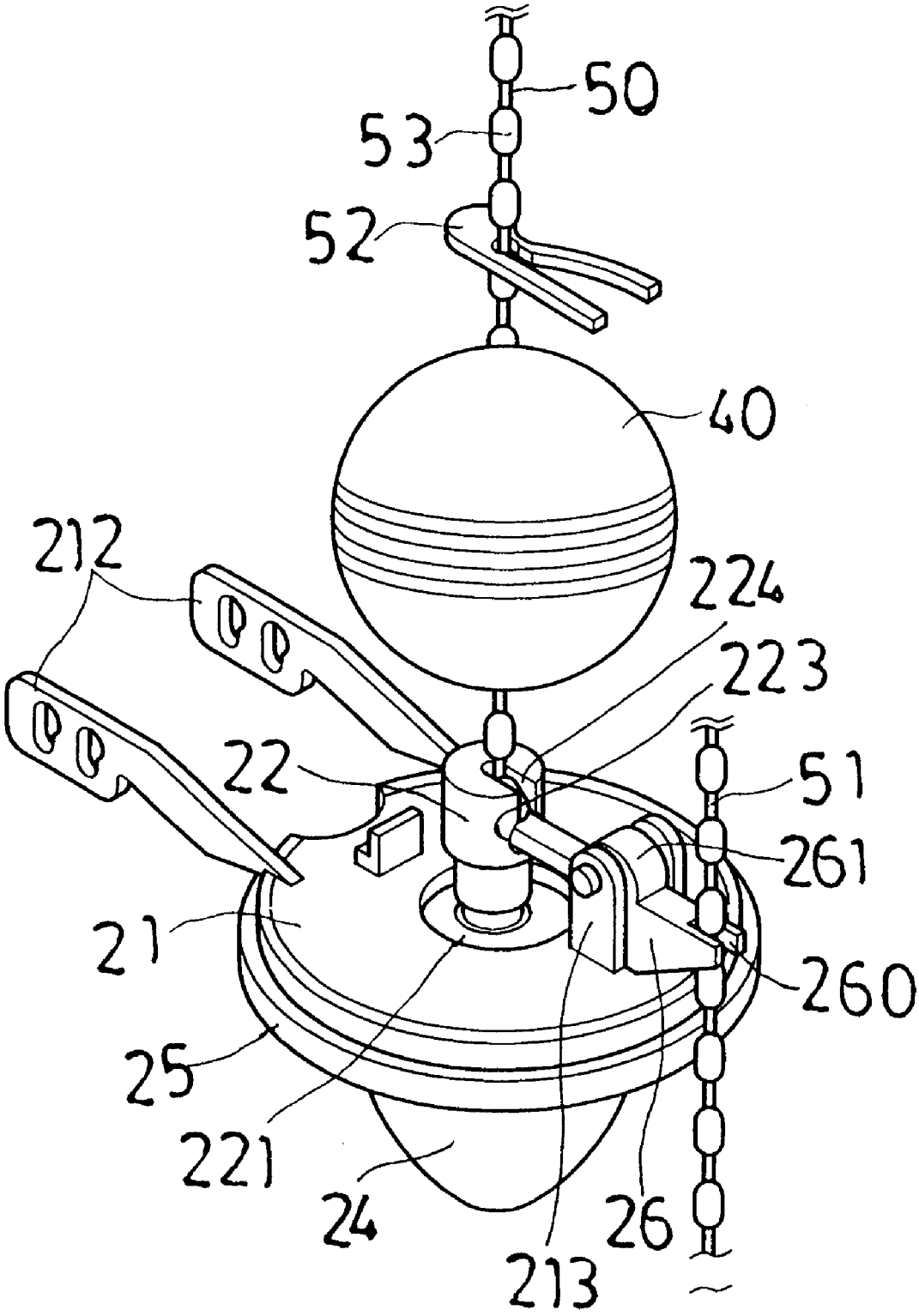
FIG. 4 is perspective view of a stop valve means of this invention.
Figure 5:
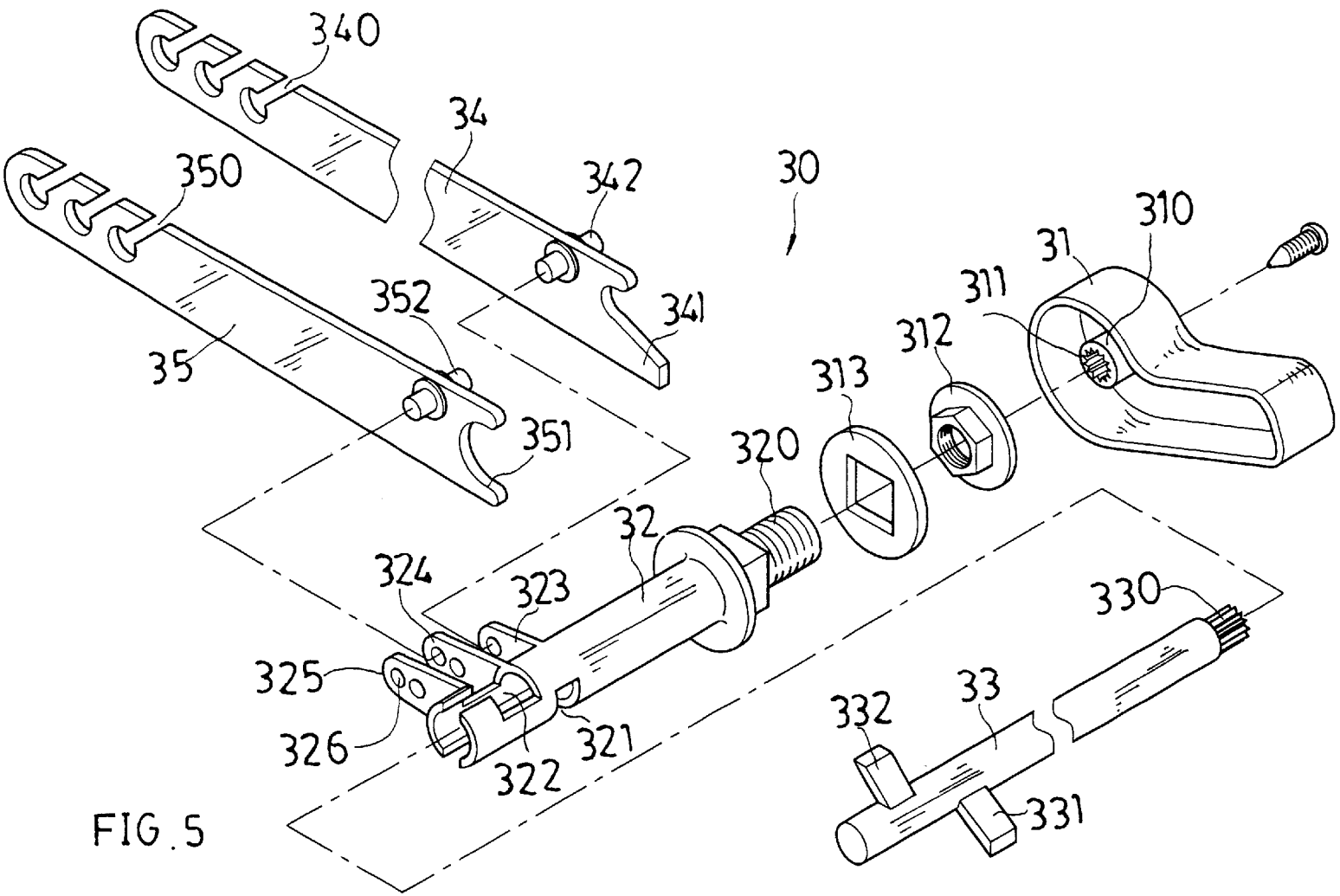
FIG. 5 is an exploded view of a linkage bar means of this invention.
Figure 6:
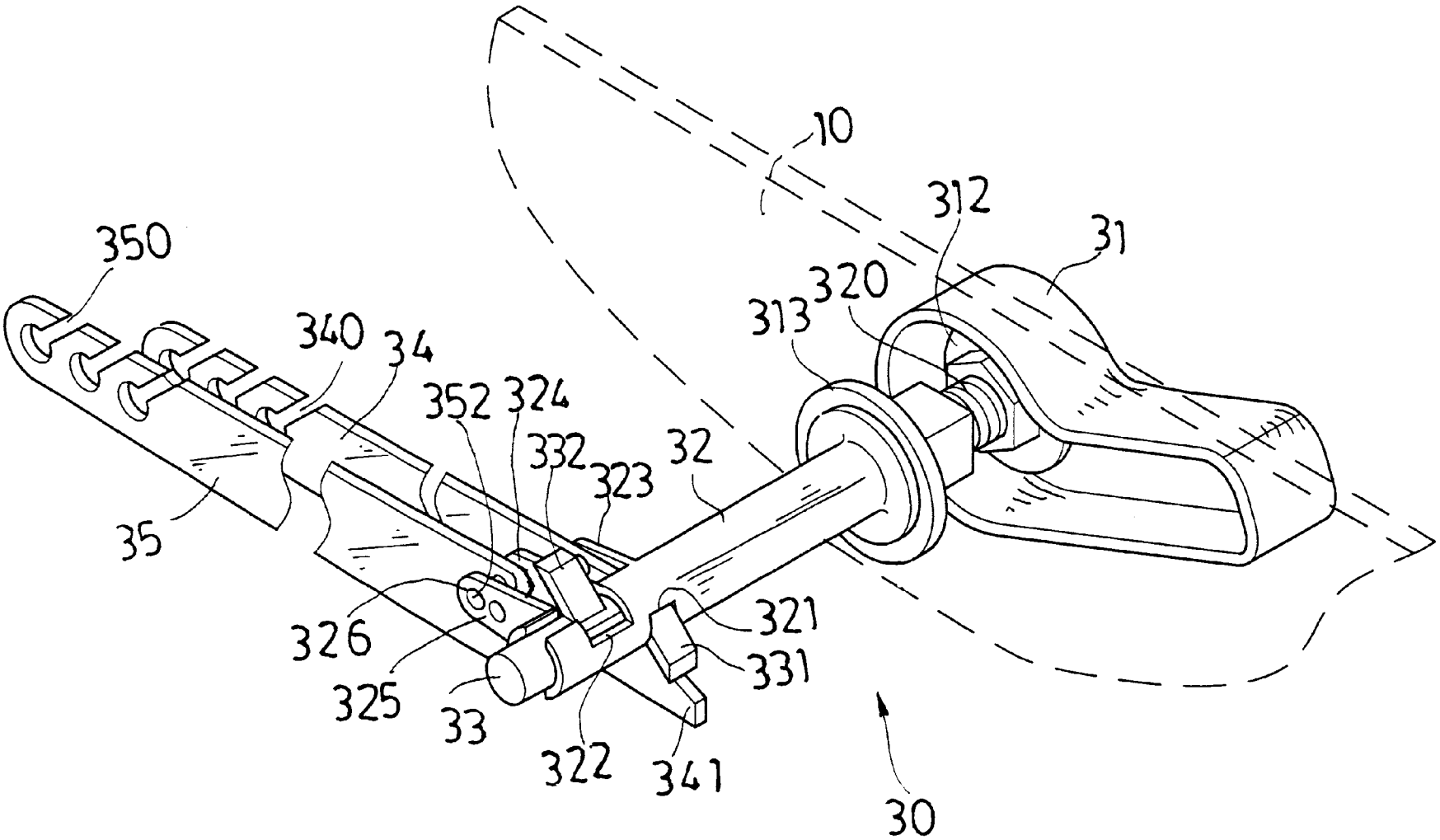
FIG. 6 is a perspective view of a linkage bar means of this invention.

Referring to FIG. 3, 4 and 5, the water saving apparatus for water tank according to this invention includes broadly a stop valve means 20, a linkage bar means 30 located above the stop valve means 20, and two chains 50 and 51 which have respectively two ends for linking the stop vave means 20 and linkage bar means 30. Aforesaid means and chains are housed in a tank 10 (shown in FIG. 6).

Figure 7:
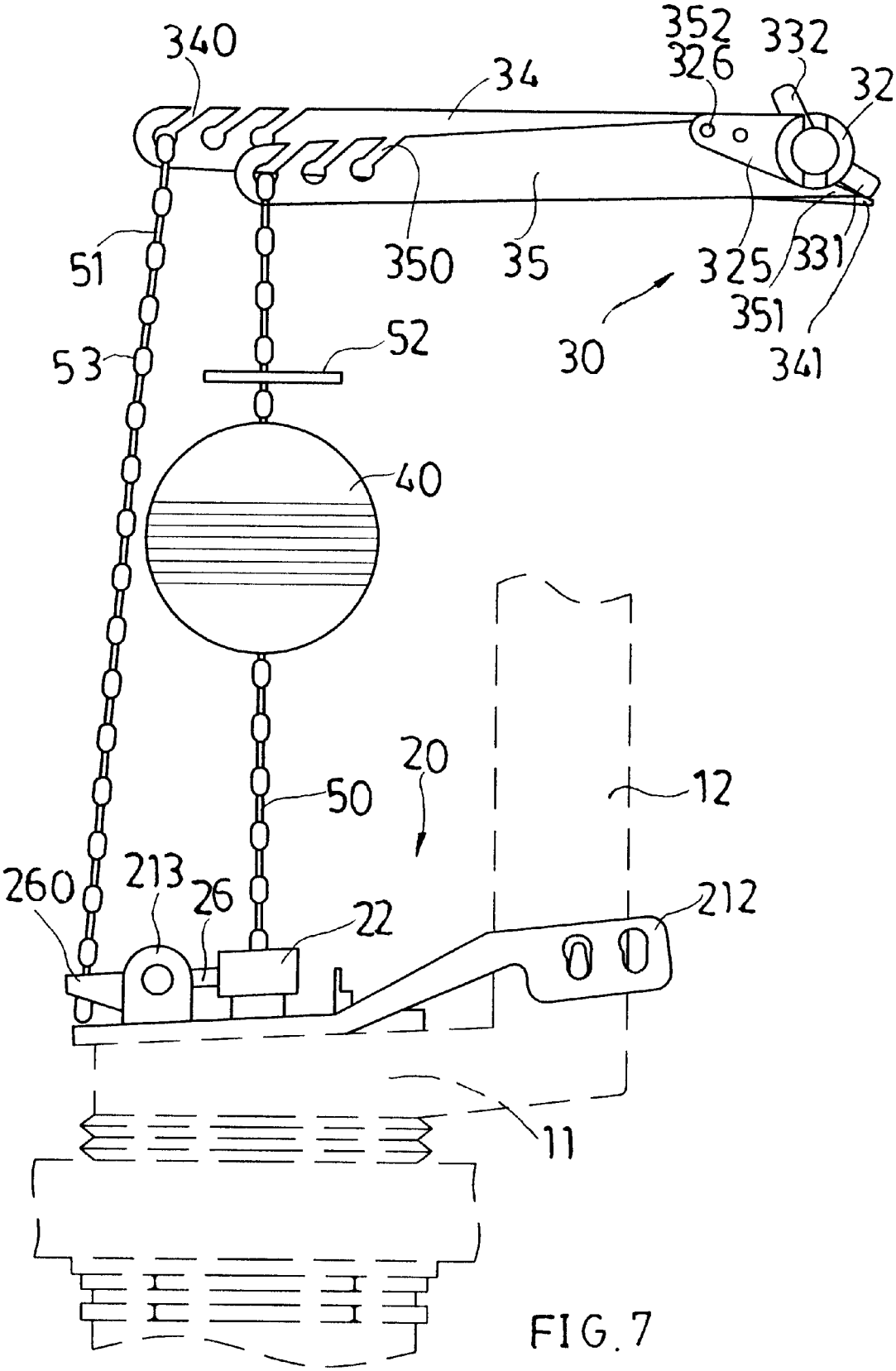
FIG. 7 is a side view of this invention.

The stop valve means 20 is located above a water outlet 11 shown in FIG. 7) and includes the following components:

A valve cap 21 has a round opening 210 in the center, an annular flange 211 extended below the opening 210, two arms 212 extended outward from one side thereof, and two valve lugs 213 located at another side thereof opposite to the arms 212 and extended upward from the top surface of the valve cap 21. The arms 212 are pivotally engaged with a pipe 12 (FIG. 7) connected with the water outlet 11 for the valve cap 21 to close or open the outlet 11 to control the flow of flush water.

A movable strut 22 has two annular recess rings 220 formed at a lower portion thereof for respectively engaging with a first valve disk 221 and a second valve disk 222, and an upper end which has a transverse trough 223 and a wedge slot 224 formed therein.

A position ring 23 is fixedly located in the annular flange 211 (also shown in FIG. 9A) for the first valve disk 221 to move between the valve cap 21 and position ring 23 without slipping out.

Figure 9A:
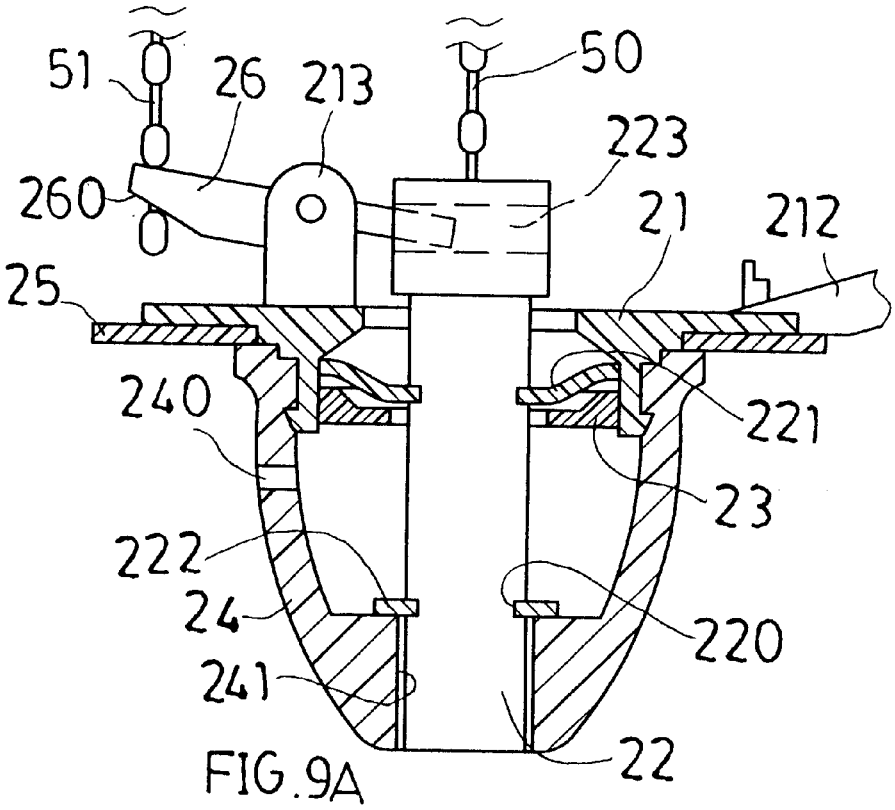
FIG. 9A is a fragmentary sectional view of a stop valve means of this invention, at an operation state.

A hollow ball 24 is formed in a semi-spherical shape for pressing against the annular flange 211 and has an inlet 240 formed in the side wall at a middle section for circulating air or water, and a through hole 241 formed at the lower portion thereof adjacent the water outlet 11 to facilitate air or water circulation (FIG. 9A).

A gasket 25 is located between the valve cap 21 and hollow ball 24 (FIG. 9A).

A rocker 26 has one end engaged with the transverse trough 223 and another end formed a pinch slot 260, and a rocker lug 261 located in a middle portion thereof for pivotally engaging with the valve lugs 213 (FIG. 9A).

The linkage bar means 30 includes the following components (referring to FIG. 5 and 6):

A handle 31 is located outside the tank 10 and includes a protrusive strut 310 in the center of an inner side, a spline 311 formed in the protrusive strut 310, a screw nut 312 and a washer 313.

A shaft sleeve 32 is located inside the tank 10 and has a first end formed with external screw threads 320 for fastening to a wall of the tank 10 through the screw nut 312, and a second end provided with a first notch 321 which has a selected first depth and a first opening pointing to a first direction, and a second notch 322 which has a selected second depth different from the first depth and a second opening pointing to a second direction different from the first direction. The second end further has a first lever 323, a second lever 324 and a third lever 325 extended outward from the side wall of the shaft sleeve 32. The first lever 323 is adjacent the first notch 321. The second lever 324 is located between the notches 321 and 322. The third lever 325 is adjacent the second notch 322. All the levers 323, 324 and 325 have respectively a bore 326 formed therein.

A shaft stem 33 is housed in the shaft sleeve 32 and has one end formed a spline shaft 330 engageable with the spline 311, and another end provided with a first finger 331 and second ginger 332.

A first beam 34 has a plurality of first slant openings 340 located at one end, a protrusive first trigger end 341 formed at another end thereof, and a first pivot strut 342 extended transversely at two opposite sides at a selected location between the first slant openings 340 and first trigger end 341.

A second beam 35 is shorter than the first beam 34 and has a plurality of second slant openings 350 located at one end, a protrusive second trigger end 351 formed at another end thereof, and a second pivot strut 352 extended transversely at two opposite sides at a selected location between the second slant openings 350 and second trigger end 351.

A tank ball 40 has a through aperture 41 (FIG. 7).

A first chain 50 and a second chain 51 each made by stringing a plurality of beads 53 through a piece of rope (FIG. 7). The first chain 50 runs through the through aperture 41 of the tank ball 40 and has a clip 52 clamped at a selected location thereof for setting the maximum floating height of the tank ball 40. The first chain 50 has the top end engaged with one of the second slant openings 350 and the bottom end thereof engaged with the wedge slot 224 (also shown in FIG. 4). The second chain 51 has the top end engaged with one of the first slant openings 340 and the bottom end thereof engaged with the pinch slot 260 (also shown in FIG. 4 and 7).

Figure 8A:
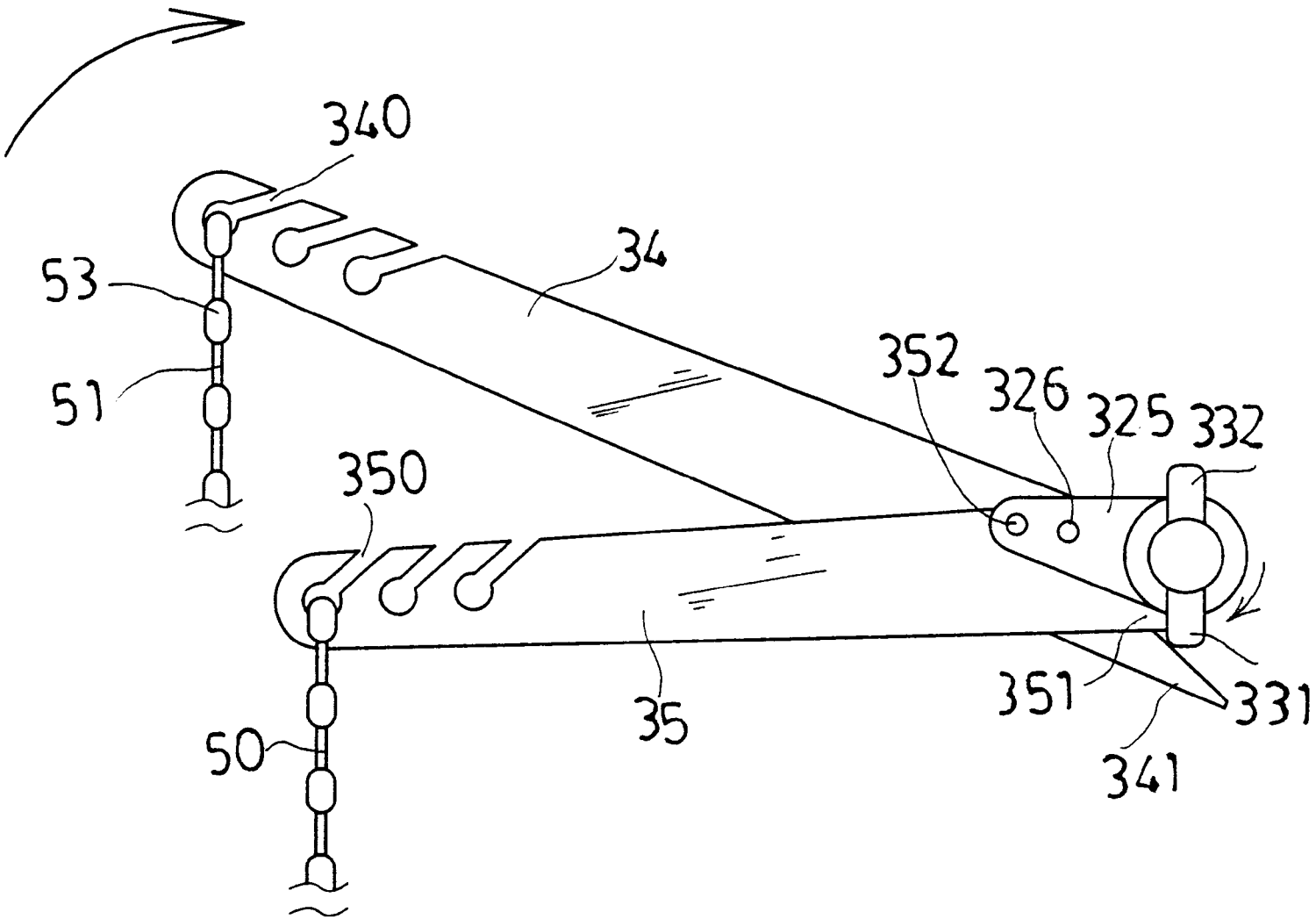
FIG. 8A is a fragmentary side view of a linkage bar means of this invention, at an operation state.

When this invention is in use (shown in FIG. 7, 8A and 9A), the handle 31 may be moved downward. The first finger 331 will be turned downward to press against the first trigger end 341 downward. The first beam 34, functioning like a lever, will move the second chain 51 upward and pull the rocker 26 upward at the end of the pinch slot 261. Then another end of the rocker 26 will press the movable strut 22 downward to make the second valve disk 222 closing the through hole 241. In the mean time, the first valve disk 221 also will be moved downward to close the position ring 23. The hollow ball 24 thus becomes buoyant. When pulling up by the floating tank ball 40, the valve cap 21 may be lifted rapidly from the water outlet 11 to release a large amount of water for flushing feces.

Figure 8B:
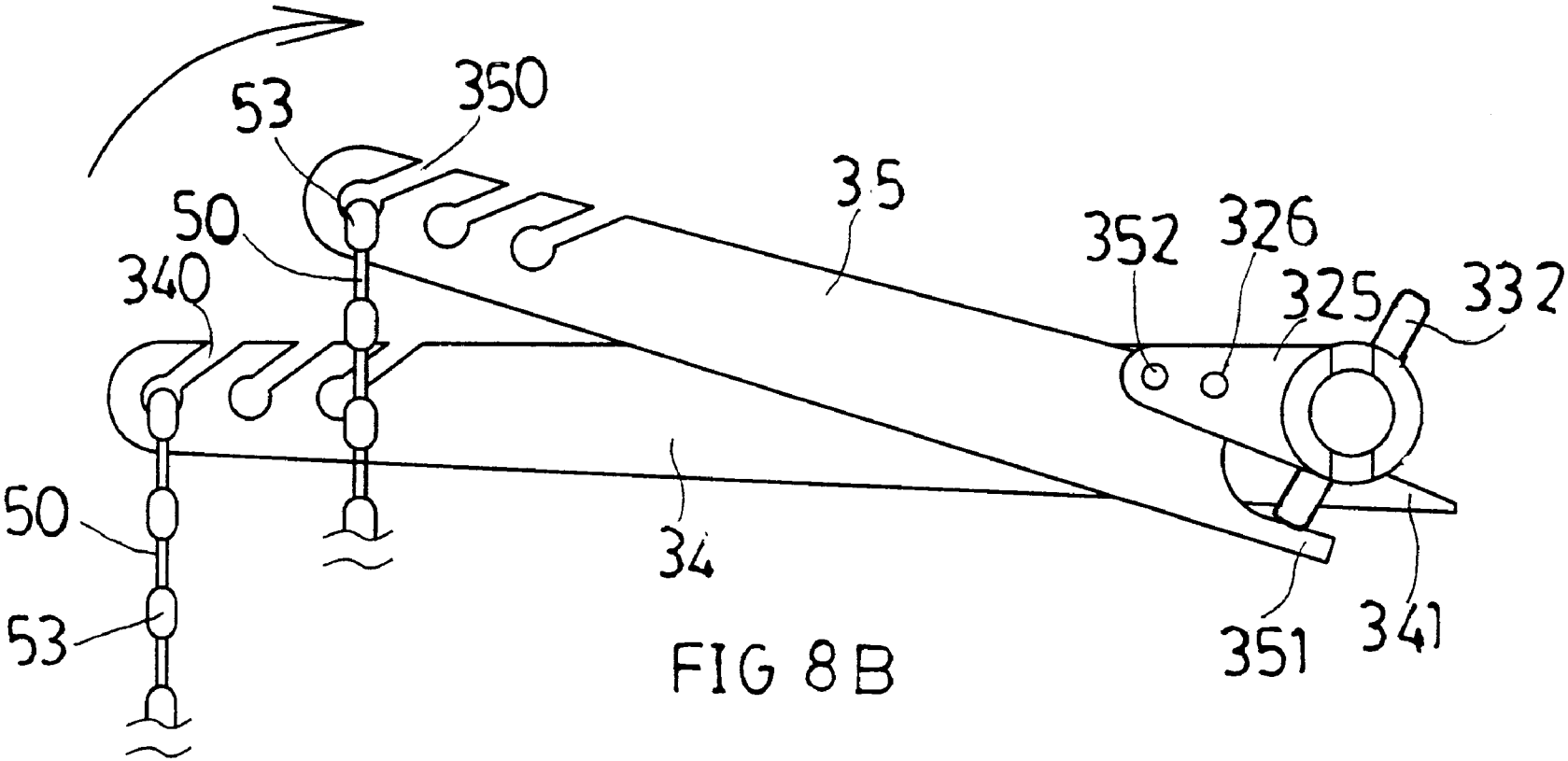
FIG. 8B is a fragmentary side view of a linkage bar means of this invention, at another operation state.
Figure 9B:
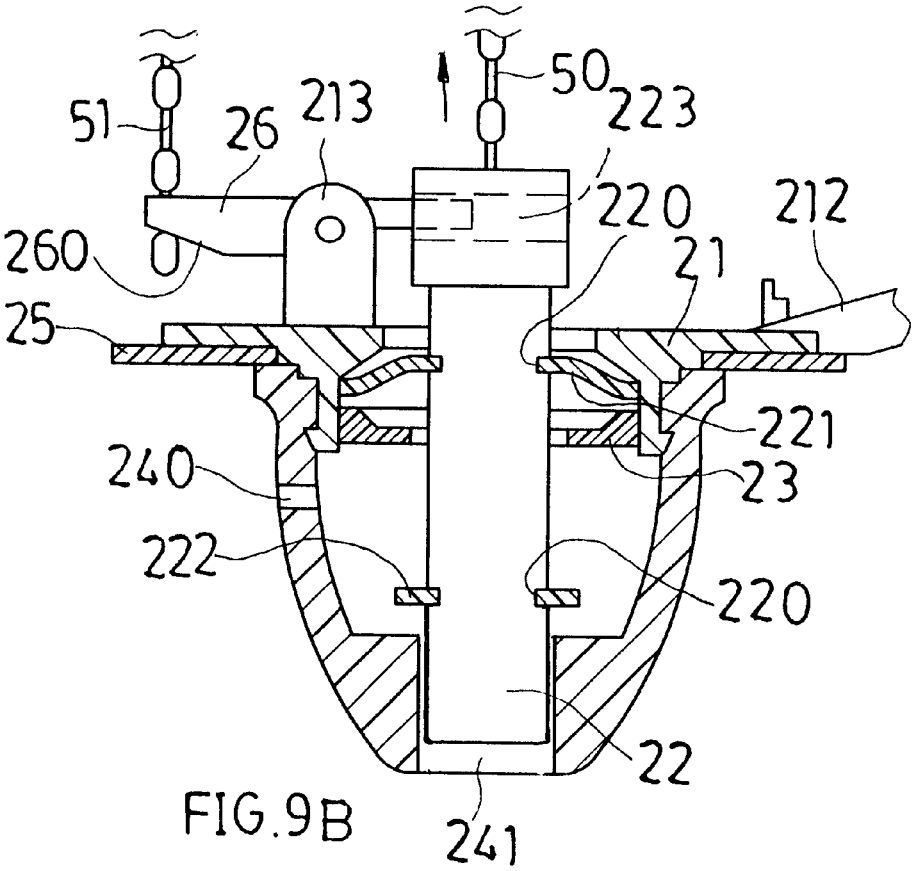
FIG. 9B is a fragmentary sectional view of a stop valve means of this invention, at another operation state.

When the handle 31 is moved upward (FIG. 7, 8B and 9B), the 20 second finger 332 will be turned to press the second trigger end 351 downward. The second beam 35, acting as a lever, will move the first chain 50 upward and pull the movable strut 22 upward. The resilient force of the first valve disk 221 will also aid to push the movable strut 22 upward. The second valve disk 222 will be moved away from the through hole 241. Then air may be circulated through the inlet 240 and though hole 241 and results in the hollow ball 24 losing buoyant force. The floating force of the tank ball 40 will move the valve cap 21 upward for flushing water. When water level in the tank 10 drops lower, the tank ball 40 also drops lower. When the valve cap 21 drops down and closing the water outlet 11, a strong water suction force will drag the valve cap 21 downward rapidly to stop water release. Hence water will be discharged at a smaller amount for flushing urine to save water consumption.

As a result, this invention may offers the following advantages:

1. Through moving the handle 31 downward or upward, the first beam 34 or second beam 35 may be moved up respectively for pressing the movable strut 22 downward or pulling the movable strut 22 upward. The hollow ball 24 may become buoyant (with the downward strut 22), which when coupling with the floating tank ball 40, may cause the tank 10 to release a large amount of water for flushing feces. On the other hand, the hollow ball 24 will become not buoyant (with the upward strut 22) because of air circulation through inlet 240 and through hole 241,. As a result, the tank ball 40 will control the tank 10 to release a small amount of water to flush urine for saving water.

2. The first valve disk 221 has resilient force to aid the pulling or pushing force for moving the movable strut 22 and second valve disk 222 up or down rapidly to perform valve function.

3. The bead structure of the chains 50 and 51 enables the clip 52 to clamp at a selected height of the chain for setting the tank ball 40 at a high desired easily and effectively. The chains 50 and 51 may be integrally formed by stringing a rope through the beads 53 for a length desired. The chains may respectively engage the movable strut 22 with the second beam 35, and engage the rocker 26 with the first beam 34, or wind around the first and second slant openings 340 and 350 flexibly at a number of times desired.

What is claimed is:

1. A water saving apparatus for a water tank, comprising in the tank a stop valve means, a linkage bar means located above the stop valve means, and two chains for connecting the stop valve means and linkage bar means, wherein:

the stop valve means is located above a water outlet of the tank and includes:

a valve cap having a round opening located at the center thereof, an annular flange formed below a bottom side thereof, a pair of arms extended outward from a side thereof for pivotally engaging with a pipe connected with the water outlet, and a pair of valve lugs extended upward from a top surface thereof, a movable strut having two annular recess rings formed at a lower section thereof for engaging respectively with a first and a second valve disk, a transverse trough located at an upper section and a wedge slot formed at a top end thereof above the trough, a position ring fixedly located in the annular flange for limiting movement of the first valve disk between the valve cap and same, a semi-spherical hollow ball pressing against the annular flange for producing a buoyant force desired for the same and having an inlet formed in a side wall thereof for circulating air, and a through hole at a lower portion thereof adjacent the water outlet to facilitate air convection, a gasket located between the valve cap and hollow ball, and a rocker having one end engageable with the transverse trough and another end thereof formed a pinch slot, and a rocker lug extended upward from a middle portion thereof for pivotally engaging with the valve lugs for the rocker to function as a lever;

the linkage bar means includes:

a handle located outside the water tank having a protrusive strut extended from an inside wall thereof, a spline formed in the protrusive strut, a screw nut and a washer located at one end of the protrusive strut, a shaft sleeve located in the water tank having external screw threads formed at one end thereof for engaging with the screw nut to fixedly mount the same on a side wall of the tank, a first and second notch formed at another end thereof which have different depths, and a first, a second and a third lever located at another end thereof, each lever has a bore formed therein, a shaft stem housed in the shaft sleeve having a spline shaft formed at one end thereof for engaging with the spline, and a first and a second finger located at another end thereof and extended outward, a first beam having a plurality of first slant openings formed at one end thereof, a protrusive first trigger end formed at another end thereof, and a first pivot strut located at a selected position at a middle section thereof and extended outward from two opposite sides thereof for pivotally engaging with the bore of the first and second lever, a second beam having a plurality of second slant openings formed at one end thereof, a protrusive second trigger end formed at another end thereof, and a second pivot strut located at a selected position at a middle section thereof and extended outward from two opposite sides thereof for pivotally engaging with the bore of the second and third lever, and a tank ball having a through aperture; the two chains each being made of a rope strung through a plurality of beads and including a first chain and a second chain, the first chain running through the aperture of the tank ball and having a clip clamped thereon at a selected location, a first upper end engaging with the second slant opening and a first lower end engaging with the wedge slot, the second chain having a second upper end engaging with the first slant opening and a second lower end engaging with the pinch slot.

* * * * *